US009482060B2

(12) United States Patent
Vaughan

(10) Patent No.: US 9,482,060 B2
(45) Date of Patent: Nov. 1, 2016

(54) ADJUSTABLE CONDUIT

(71) Applicant: Susanne F Vaughan, Austin, TX (US)

(72) Inventor: Susanne F Vaughan, Austin, TX (US)

( * ) Notice: Subject to any disclaimer, the term of this patent is extended or adjusted under 35 U.S.C. 154(b) by 0 days.

(21) Appl. No.: 14/446,202

(22) Filed: Jul. 29, 2014

(65) Prior Publication Data

US 2016/0032661 A1 Feb. 4, 2016

(51) Int. Cl.

| | |
|---|---|
| ***E21B 17/20*** | (2006.01) |
| ***E21B 17/04*** | (2006.01) |
| ***E21B 17/01*** | (2006.01) |
| ***E21B 17/02*** | (2006.01) |
| *E21B 43/01* | (2006.01) |

(52) U.S. Cl.

CPC ..... *E21B 17/04* (2013.01); *E21B 17/012* (2013.01); *E21B 17/028* (2013.01); *E21B 2043/0115* (2013.01)

(58) Field of Classification Search

CPC ..... E21B 17/04; E21B 17/01; E21B 17/012; E21B 17/028; E21B 17/18; E21B 17/20; E21B 17/203; E21B 17/206

USPC ..... 166/350

See application file for complete search history.

(56) References Cited

U.S. PATENT DOCUMENTS

| | | | |
|---|---|---|---|
| 2,096,279 | A | 10/1937 | Karcher |
| 2,473,430 | A | 6/1949 | Hoffar |
| 2,748,358 | A | 5/1956 | Johnston |
| 2,951,680 | A | 9/1960 | Camp et al. |
| 3,019,813 | A | 2/1962 | Gunther |
| 3,045,611 | A | 7/1962 | Murray |
| 3,065,807 | A | 11/1962 | Wells |
| 3,076,737 | A | 2/1963 | Roberts |
| 3,077,358 | A | 2/1963 | Costa |
| 3,421,718 | A | 1/1969 | Gehringer et al. |
| 3,467,013 | A | 9/1969 | Conner |
| 3,469,601 | A | 9/1969 | Harper |
| 3,504,872 | A | 4/1970 | Russell |
| 3,517,110 | A | 6/1970 | Morgan |
| 3,573,348 | A | 4/1971 | Herrmann |
| 3,768,842 | A | 10/1973 | Ahlstone |
| 3,820,446 | A | 6/1974 | Granbom et al. |
| 3,841,357 | A | 10/1974 | Heijst |
| 3,844,345 | A | 10/1974 | Evans et al. |
| 3,847,184 | A | 11/1974 | God |
| 3,879,097 | A | 4/1975 | Oertle |
| 3,881,530 | A | 5/1975 | Faldi |
| 3,884,528 | A | 5/1975 | Shaddock |

(Continued)

FOREIGN PATENT DOCUMENTS

| | | |
|---|---|---|
| FR | 746015 | 5/1933 |

OTHER PUBLICATIONS

Marine Installations, Feb. 2009, pp. 359-395,Chapter 10.

(Continued)

*Primary Examiner* — Amber Anderson
*Assistant Examiner* — Patrick Lambe
(74) *Attorney, Agent, or Firm* — Cesari & Reed LLP; R. Michael Reed

(57) ABSTRACT

An apparatus includes a fluid conduit including a plurality of segments having a substantially flexible segment. The substantially flexible segment has substantially concentric inner and outer sidewalls and includes an adjustable pressure device configured to vary an internal annular pressure of the substantially flexible segment to counteract external pressure from a surrounding environment.

23 Claims, 10 Drawing Sheets

(56) References Cited

U.S. PATENT DOCUMENTS

| | | | | |
|---|---|---|---|---|
| 3,899,631 | A | 8/1975 | Clark | |
| 4,098,342 | A | 7/1978 | Robinson et al. | |
| 4,116,009 | A | 9/1978 | Daubin | |
| 4,120,168 | A | 10/1978 | Lamy | |
| 4,172,473 | A | 10/1979 | Kunz et al. | |
| 4,484,511 | A | 11/1984 | Dibrell | |
| 4,545,290 | A | 10/1985 | Lieberman | |
| 4,753,554 | A | 6/1988 | Jeter | |
| 4,838,147 | A | 6/1989 | Grishchenko | |
| 4,953,636 | A | 9/1990 | Mohn | |
| 4,997,048 | A | 3/1991 | Isom | |
| 5,141,057 | A | 8/1992 | Chaix | |
| 5,657,682 | A | 8/1997 | Thomas et al. | |
| 6,004,074 | A * | 12/1999 | Shanks, II | E21B 17/012 166/350 |
| 6,220,079 | B1 | 4/2001 | Taylor et al. | |
| 6,634,388 | B1 | 10/2003 | Taylor et al. | |
| 6,666,274 | B2 | 12/2003 | Hughes | |
| 2011/0023987 | A1 | 2/2011 | Zucker et al. | |
| 2011/0067880 | A1 * | 3/2011 | Adamek | E21B 17/01 166/345 |
| 2011/0173978 | A1 | 7/2011 | Rekret et al. | |
| 2011/0186297 | A1 * | 8/2011 | Zhang | C09K 8/70 166/308.1 |
| 2013/0126154 | A1 * | 5/2013 | Williamson, Jr. | E21B 34/06 166/65.1 |

OTHER PUBLICATIONS

International Search Report and Written Opinion, PCT/US15/42239, Aug. 26, 2016, 8 pages.

* cited by examiner

ADJUSTABLE CONDUIT

FIELD

The present disclosure is generally related to underwater harvesting operations, and more particularly to buoyancy adjustable conduits for recovery of material, such as methane gas, from underwater deposits.

BACKGROUND

Underwater operations for recovery of gas from clathrate hydrate deposits may utilize a conduit for delivery of the gas from the underwater deposit to the surface. The term "clathrate hydrates" (or gas clathrates, gas hydrates, clathrates, etc.) refer to crystalline water-based solids physically resembling ice, in which gases may be trapped. Recovery of gases from such solids may utilize a harvester to break up the clathrate, such as the harvester disclosed in co-pending U.S. patent application Ser. No. 13/051,919 entitled "Systems and Methods for Harvesting Natural Gas from Underwater Clathrate Hydrate Deposits," which was filed on Mar. 18, 2011 and which is incorporated herein by reference in its entirety. The released gas may be captured within a conduit that may direct the gas toward a vessel at the surface. At various depths, water pressure and underwater currents may apply external pressure on the conduit.

SUMMARY

In certain embodiments, an apparatus may include a fluid conduit including a plurality of segments having a substantially flexible segment. The substantially flexible segment may have substantially concentric inner and outer sidewalls and may include an adjustable pressure device configured to vary an internal annular pressure of the substantially flexible segment to counteract external pressure from a surrounding environment. In a particular aspect, the apparatus may include an adjustable buoyancy device.

In other certain embodiments, an apparatus may include a tubular conduit including a substantially flexible segment. The substantially flexible segment may include a first coupling element, a second coupling element, and a tubular structure. The first coupling element may include a first electrical interface and a first fluid opening. The second coupling element may include a second electrical interface and second fluid opening. The tubular structure may include inner and outer tubular sections coupled between the first coupling element and the second coupling element. The inner tubular section may be configured to define a fluid passage from the first fluid opening to the second fluid opening, the outer tubular section spaced apart from the inner tubular section to define an annular space. The substantially flexible segment may further include a fluid disposed within the annular space and configured to vary an internal annular pressure within the annular space of the substantially flexible segment to counteract external pressure from a surrounding environment. In certain aspects, the fluid may be a smart fluid having at least one property that changes in response to variations in the external pressure to selectively vary the internal annular pressure.

In still other certain embodiments, an apparatus may include a fluid conduit including a plurality of segments. At least one of the plurality of segments may include first and second coupling elements, a first tube, a second tube, and a fluid. Each coupling element may include an electrical interface and a fluid opening. The first tube may be coupled between the first and second coupling elements and may be configured to mate with the fluid openings to form a fluid path. The second tube may be coupled between the first and second coupling elements and spaced apart from the first tube to form an annular space. The fluid may be disposed within the annular space and may be configurable to vary an internal annular pressure of the annular space to counteract external pressure from a surrounding environment.

In certain embodiments, a connector between segments of a fluid conduit system may include a plunger configured to move in response to external pressure and to apply a compression force to an incompressible fluid to provide a varying annular pressure within a particular segment.

In certain embodiments, a segment may include an annular cavity filled with a smart fluid. In certain embodiments, the smart fluid may be responsive to an external environmental parameter, such as temperature, pressure, movement, and the like, and, in response to such an external environmental parameter, a characteristic of the smart fluid (such as viscosity, density, etc.) may vary. In certain embodiments, the smart fluid may be responsive to an applied field (magnetic or electrical) and, in response to such a suitable field, a characteristic of the smart fluid (such as viscosity, density, etc.) may vary. In certain embodiments, variation of the characteristic of the smart fluid may alter an annular pressure within a segment of a conduit, which may vary a flexibility of the segment. In certain embodiments, increasing the annular pressure may reduce flexibility, while decreasing the annular pressure may increase flexibility.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

Figure 1:
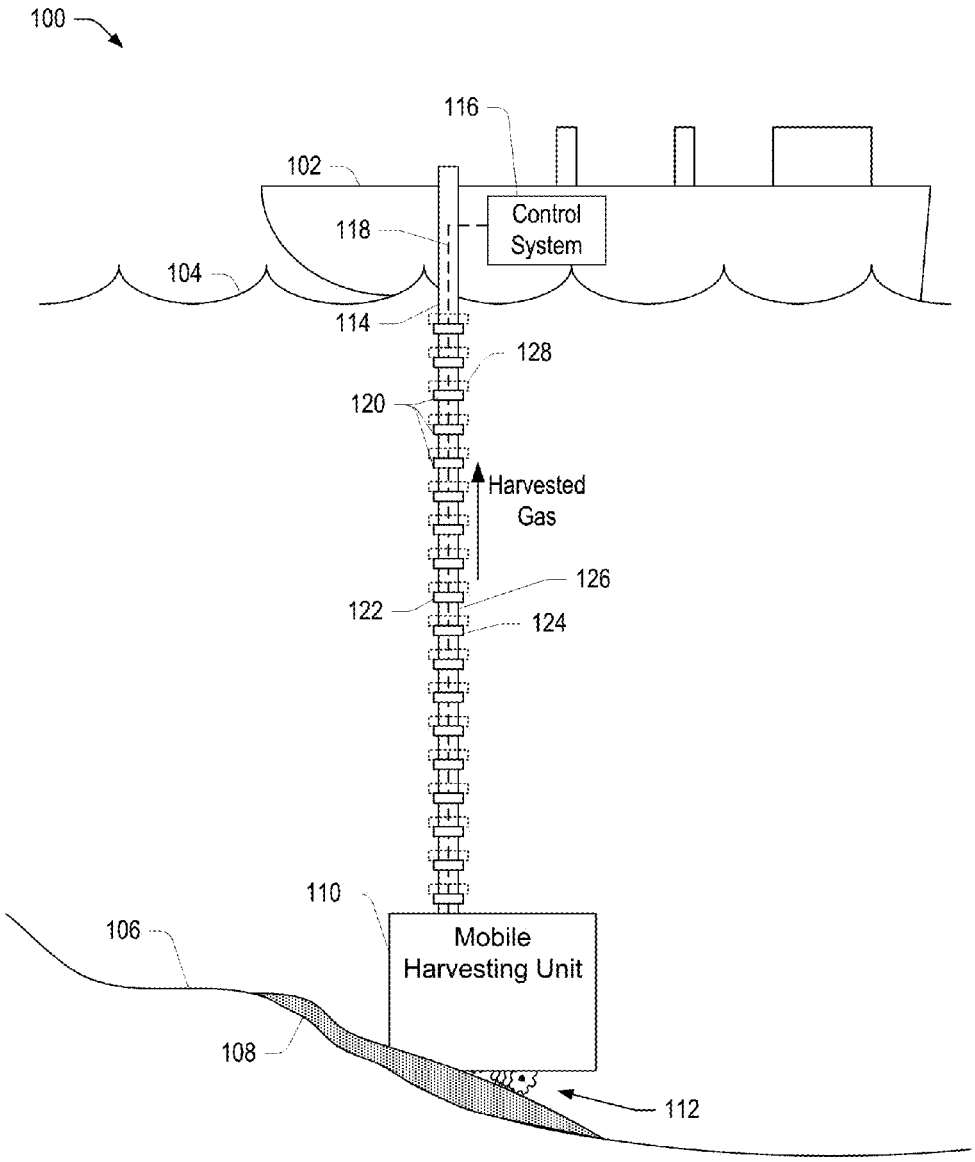
FIG. 1 is a diagram of an adjustable conduit system according to certain embodiments.

In the following detailed description of embodiments, reference is made to the accompanying drawings which form a part hereof, and which are shown by way of illustrations. It is to be understood that features of various described embodiments may be combined, other embodiments may be utilized, and structural changes may be made without departing from the scope of the present disclosure. It is also to be understood that features of the various embodiments and examples herein can be combined, exchanged, or removed without departing from the scope of the present disclosure.

In accordance with various embodiments, the methods and functions described herein may be implemented as one or more software programs running on a computer processor or controller. In accordance with various embodiments, the methods and functions described herein may be implemented as one or more software programs running on a computing device, such as a tablet computer, smartphone, personal computer, server, or any other computing device. Dedicated hardware implementations including, but not limited to, application specific integrated circuits, programmable logic arrays, and other hardware devices can likewise be constructed to implement the methods and functions described herein. Further, the methods described herein may be implemented as a device, such as a computer readable storage medium or memory device, including instructions that when executed cause a processor to perform the methods.

Embodiments of an adjustable conduit are described below that include at least one of an adjustable annular pressure and an adjustable buoyancy. Embodiments described below may be used together or separately to provide an adjustable conduit that may be utilized in a variety of environments, including underwater or within sludge or other fluids. In certain embodiments, the adjustable conduit may be flexible and may include rigid connectors to interconnect adjacent segments within a plurality of conduit segments both electrically and physically. In certain embodiments, the flexibility of each segment of the conduit may be at least partially adjustable, either by adjusting an annular pressure within an annular cavity of the conduit or by adjusting a parameter of a smart fluid within the annular cavity.

Further, depending on the implementation, it may be desirable to provide an adjustable buoyancy. In certain embodiments, a buoyancy device may be coupled to connectors between adjacent conduits and may be configured to selectively adjust a buoyancy parameter of the buoyancy device in response to control signals. In an implementation involving harvesting of gases, such as methane or other gases from deep water harvesting operations, the gases may increase the buoyancy of the conduit, and the adjustable buoyancy devices may have an adjustable buoyancy parameter, which may be controlled to provide a selected buoyancy.

While the first exemplary implementation of the conduit system relates to methane clathrate harvesting, it should be appreciated that other applications for the conduit are also possible. Many such applications for the conduit may be determined by those skilled in the art in light of the disclosure. One possible implementation out of numerous possible implementations of the conduit system is described below with respect to FIG. 1.

FIG. 1 is a diagram of a system 100 according to certain embodiments. In this particular illustrative embodiment, the system 100 may be configured for recovery of methane or other gases from an underwater deposit. It should be appreciated that the system 100 is depicted for illustrative purposes only and is not drawn to scale. In a certain embodiment, the system 100 may be configured to harvest methane clathrate from a clathrate hydrate deposit that may have formed underwater, along a continental shelf at depths of over one thousand meters.

The system 100 includes a mobile harvesting unit 110 for recovering methane clathrate and coupled to a process ship 102 via a conduit system 114. The process ship 102 is at the surface 104 of a body of water. The harvesting unit 110 is deployed at an underwater surface 106 that includes a clathrate hydrate deposit 108. In certain embodiments, the conduit system 114 may be pressurized to draw fluid, clathrate, methane and debris toward the surface 104.

In certain embodiments, the harvesting unit 110 includes a plow (not shown) configured to uncover the clathrate deposit 108, such as by displacing sediment to expose the clathrate deposit 108. The harvesting unit 110 may also include a harrow having one or more blades 112 configured to cut and break the clathrate into pieces, forming a slurry that is drawn (or pumped) into conduit system 114. The harvesting unit 110 or a portion of the conduit system 114 may include a slurry separator (not shown), which may include a centrifuge, filters, mixers, other components, or any combination thereof, which can cooperate to separate methane gas from the slurry, dispelling water, ice and debris and allowing the harvested gas to flow through the conduit system 114 to the process ship 102. In certain embodiments, the process ship 102 may include a control system 116, which may communicate power and control signals to the harvesting unit 110 and optionally to circuitry associated with the conduit system 114 through wiring 118, which may extend from the control system 116 to the harvesting unit through the conduit system 114.

In certain embodiments, the conduit system 114 may include a plurality of segments, which may be coupled together to form the conduit system 114. In certain embodiments, one or more of the segments may be formed from a flexible material. Each conduit segment includes a connector on each end of the segment configured to mate with a corresponding connector of a next segment, which connectors are generally indicated at 120. In an example, the conduit system 114 includes a first connection 122 and a second connection 124 with a flexible conduit segment 126 extending therebetween. In certain embodiments, the fluid conduit segment 126 may extend one hundred feet or more. The first connection 122 may include a male connector and a female connector that are physically and electrically coupled and secured by spanner wrench quick-connect sleeve. In other implementations, a different type of connector may be employed, depending on the use for which the conduit 114 is intended.

Each of the connectors 120 includes a central opening for fluid passage and includes one or more electrical connectors configured to electrically couple adjacent segments of the plurality of segments. Further, in certain embodiments, each of the segments includes an inner conduit coupled to a first connector on one end (such as a male connector) and to a second connector (such as a female connector) on another end and may be configured to mate with the central openings to form a fluid passage from a first opening of a first connector to a second opening of the second connector. Further, each segment may include an outer conduit coupled to the first connector and to the second connector and spaced apart from the inner conduit to form an annular cavity, which may be filled with an substantially incompressible fluid. The annular cavity may be sealed to prevent the fluid from escaping. In certain embodiments, the fluid may include a silicon oil.

In certain embodiments, external pressure from the surrounding environment may compress the outer conduit, applying a hoop stress. In response to the external pressure, the conduit system 114 may selectively alter an annular pressure within the annular cavity to counteract the external pressure. In certain embodiments, a plunger may respond to the external pressure to apply pressure to the substantially incompressible fluid to increase the annular pressure.

In certain embodiments, the fluid may include a smart fluid that may have a characteristic or property (such as fluid viscosity, fluid density, fluid volume, etc.) that changes in response to an external excitation. Such external excitations may include external environmental factors, such as pressure, temperature, motion, another parameter, or any combination thereof. Such external excitations may include low-power control signals, electrical fields, magnetic fields, radio frequency signals, or any combination thereof. In certain embodiments, the fluid may include an electrorheological (ER) smart fluid that may include semi-conducting particles suspended in a dielectric oil. In certain embodiments, the fluid may include a magnetorheological (MR) smart fluid that may include magnetizeable particles suspended in a non-magnetizeable carrier liquid. In certain embodiments, excitation of the smart fluid by an electrical field or a magnetic field may cause polarization and subsequent alignment of the particles suspended within the fluid. The resulting chain structure may be held in place by the applied field, and hence may resist fluid flow. In certain embodiments, the smart fluid may exhibit a yield stress that is a function of the applied electric or magnetic field. In an example, the conduit system 114 may include one or more circuits configured to selectively apply a field (i.e., an electrical field or a magnetic field) in response to changes in pressure to selectively alter the characteristic of the smart fluid, which may in turn alter a characteristic of the corresponding segment, such as segment 126 of the conduit system 114, such as a flexibility characteristic. In certain embodiments, increasing an applied field may alter a physical parameter of the smart fluid to alter an internal annular pressure of the segment 126. Increasing the internal annular pressure may decrease the flexibility of the segment, while decreasing the internal annular pressure may increase the flexibility.

In certain embodiments, one or more of the segments, such as segment 126, may be formed from any material suitable for use in deep water. In certain embodiments, one or more of the segments 126 of the conduit system 114 may be formed from a substantially flexible tubing material and may be coupled to harvesting unit 110 to apply a vacuum-type of draw to the slurry to pull the slurry into the conduit system 114, and the adjustable annular pressure within the annular cavity of the segments of the conduit may both counteract external pressure and prevent the inner conduit from collapsing under the combined pressure differential of the applied negative pressure and of the external hoop stresses from the environment.

In certain embodiments, one or more of the segments may also include an adjustable buoyancy device 128, which may be configured to provide a desired buoyancy to one or more segments of the conduit system 114. A segment of the conduit system 114 may be provided with one or more of the adjustable buoyancy devices 128. The adjustable buoyancy device 128 may include a mechanism (such as a bi-directional valve and pump) to selectively receive or eject water from or into the surrounding environment to adjust a buoyancy of the adjustable buoyancy device 128 to maintain a substantially buoyancy neutral conduit 114. Depending on gas volume and depth, it may be desirable to selectively adjust the buoyancy of the adjustable buoyancy conduit, in situ, to provide a desired buoyancy.

In certain embodiments, the segments of the conduit may be stored without the fluid within the annular cavity, decreasing the weight of each segment and allowing the segments to be stacked or rolled during storage and transport. Further, it is possible for the fluid within the annular cavity to be different from segment to segment.

Figure 8:
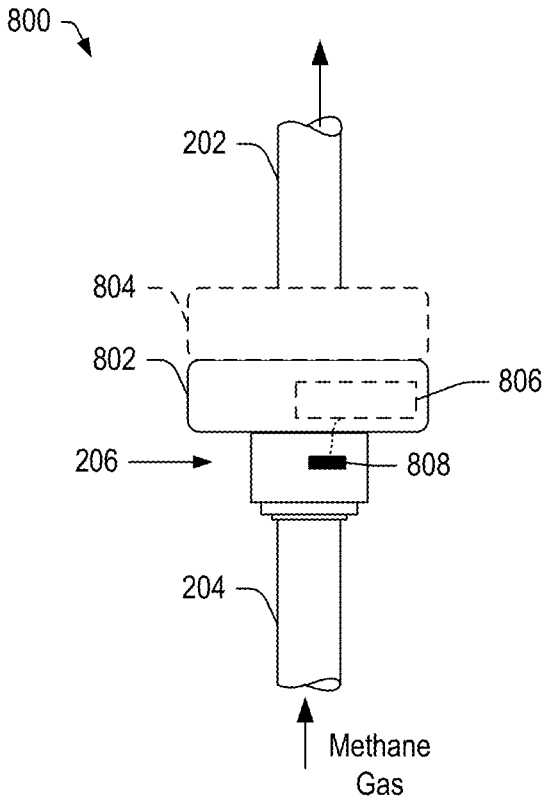
FIG. 8 is a diagram of a portion of the adjustable conduit including an adjustable buoyancy device according to certain embodiments.
Figure 9:
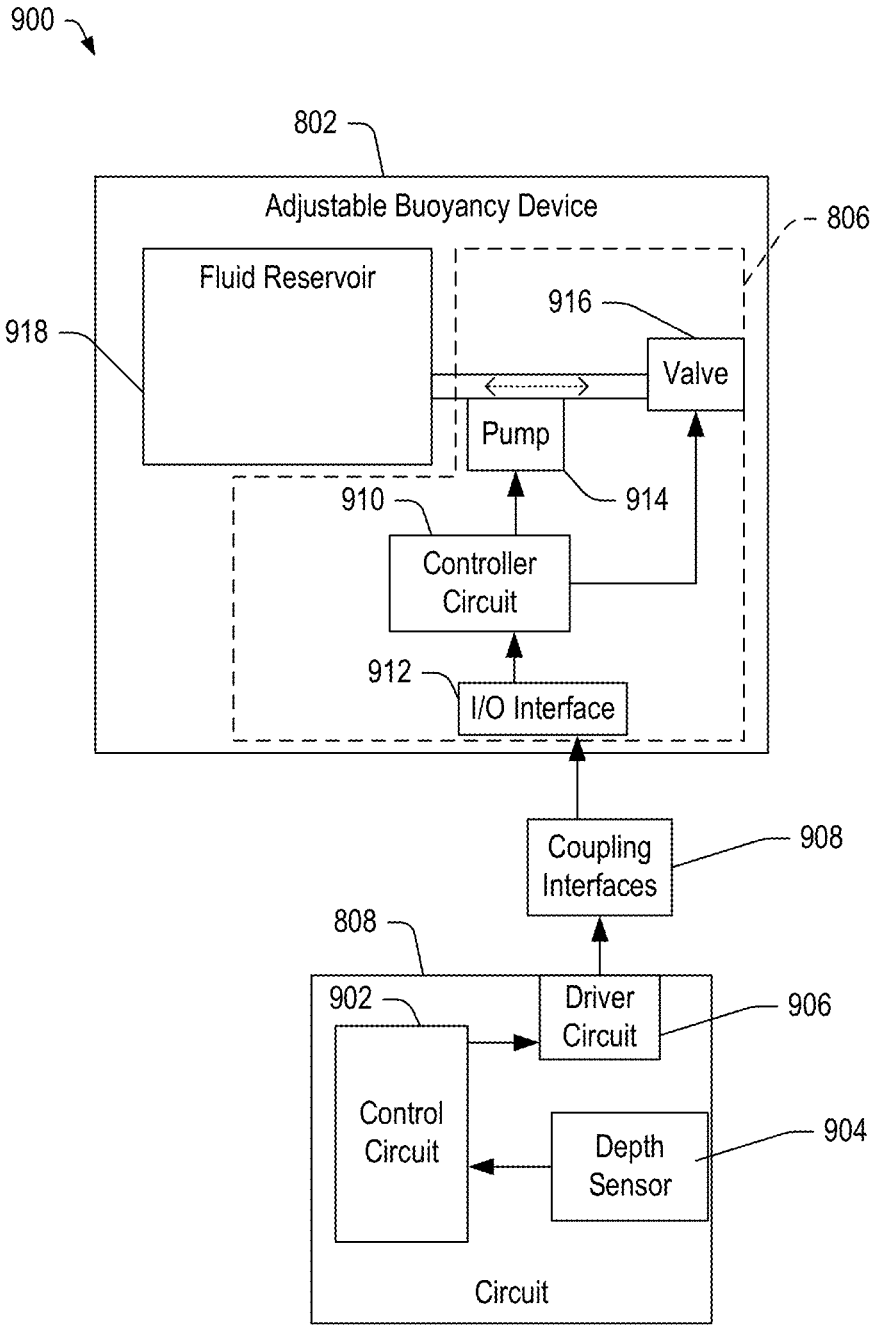
FIG. 9 is a block diagram of a system configured to control the adjustable buoyancy device of FIG. 8 according to certain embodiments.

In the following discussion, certain embodiments of the connection features and adjustable annular pressure features are described first with respect to FIGS. 2-7. In FIGS. 8 and 9, certain embodiments of the adjustable buoyancy device 128 are described.

Figure 2:
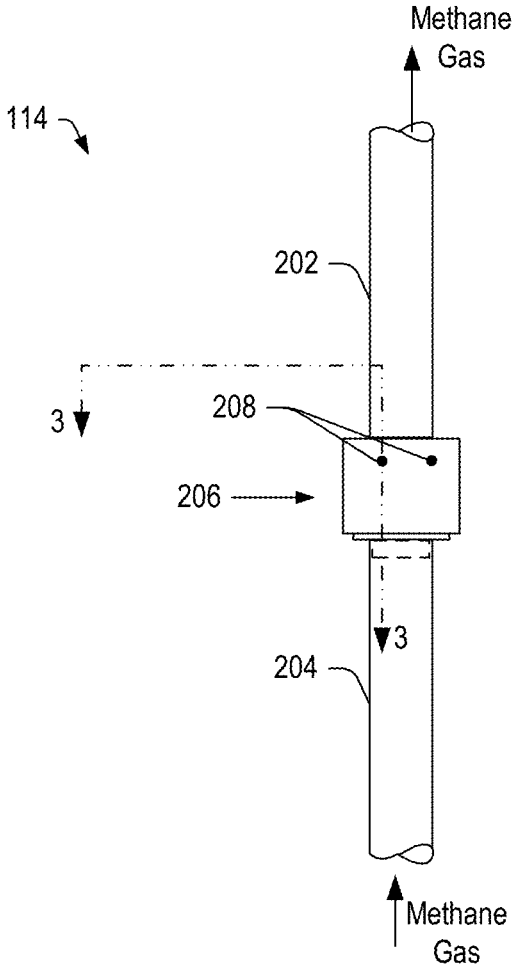
FIG. 2 is a diagram of a portion of the adjustable conduit system of FIG. 1, according to certain embodiments.

FIG. 2 is a diagram of a portion of the adjustable conduit system 114 of FIG. 1, according to certain embodiments. The portion of the adjustable conduit system 114 may include a flexible tubing portion 202 and a flexible tubing portion 204 that are coupled by a quick-connect coupling 206. In the illustrated example, the quick-connect coupling 206 may include a male connector sleeve and a female connector that are threadably coupled and a quick-connect sleeve that includes a spanner wrench interface 208. In the illustrated example, the spanner wrench interface 208 includes spanner wrench holes accessible using a spanner wrench to secure or disconnect the quick-connect sleeve. In certain embodiments, a flat wrench interface may be provided in the alternative to or in addition to the spanner wrench holes.

Figure 3:
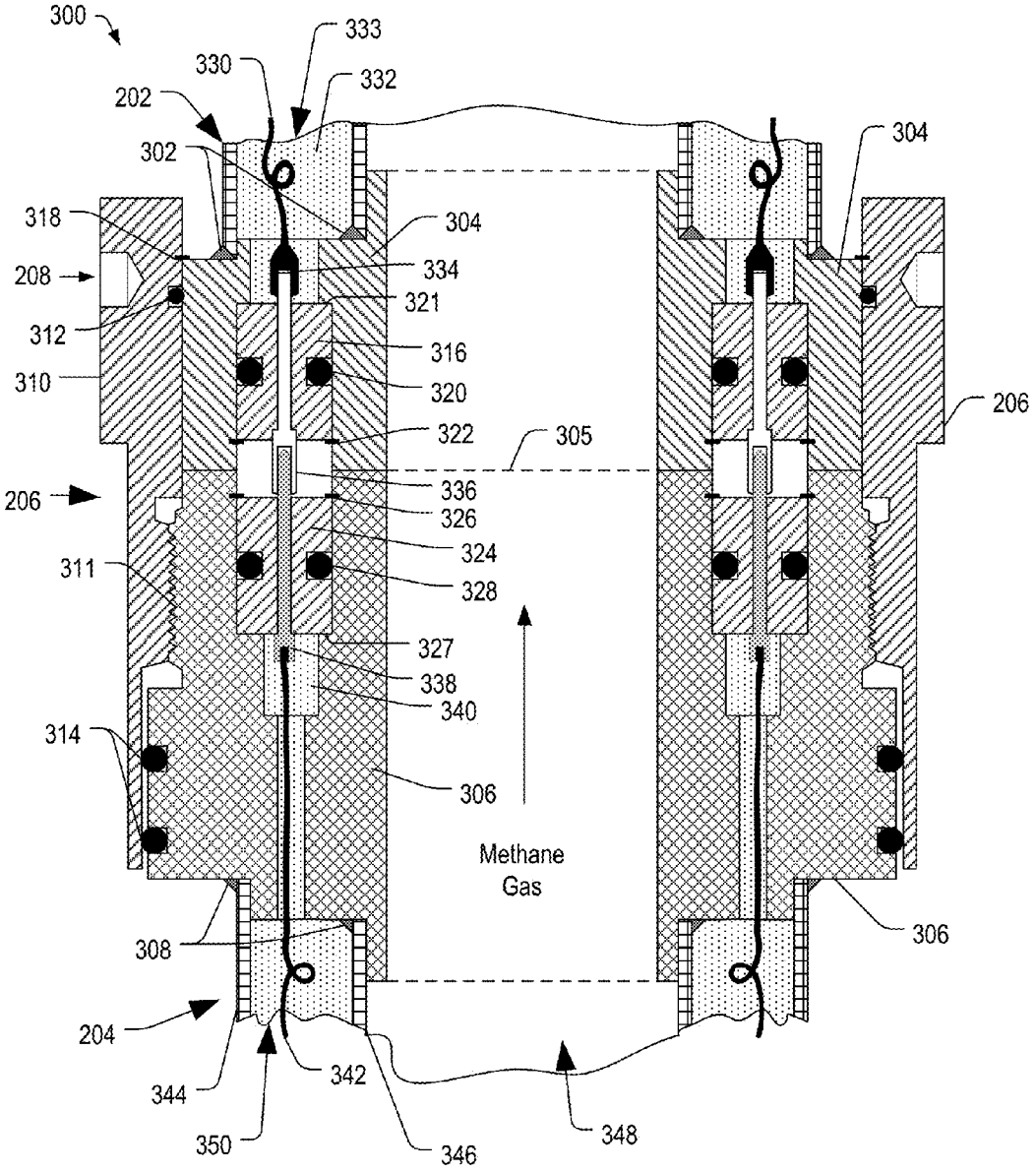
FIG. 3 is a cross-sectional view of the adjustable conduit taken along line 3-3 in FIG. 2 according to certain embodiments.

FIG. 3 is a cross-sectional view of the adjustable conduit system 114 taken along line 3-3 in FIG. 2 according to certain embodiments. The conduit system 114 includes the flexible tubing portions 202 and 204 coupled to each other via the quick-connect coupling 206. The quick-connect coupling 206 further includes spanner wrench openings 208. Flexible tubing portion 202 may be welded to a female connector 304 at weld location 302. The female connector 304 may contact a male connector 306 at a connection interface 305. The male connector 306 is coupled to flexible tubing portion 204 at a weld location 308. The quick-connect coupling 206 includes a sleeve 310, which extends over the female connector 304 and threadably engages the male connector 306 at thread interface 311 to secure the female connector 304 and the male connector 306 in contact along the connection interface 305. O-ring 312 may provide a fluid seal between the sleeve 310 and the female connector 304, and the O-rings 314 may provide fluid seals between the sleeve 310 and the male connector 306. A snap ring or shoulder 318 may secure the female connector 304 within the sleeve 310.

The female connector 304 may include an insulator 316. An O-ring 320 may seal the insulator 316 against sidewalls to seal the annular cavity within the flexible tubing portion 202 from the connection interface 305. A shoulder 321 may cooperate with a snap ring 322 to secure the insulator 316.

The male connector 306 may include an insulator 324. An O-ring 328 may seal the insulator 324 against sidewalls to seal an annular cavity of the flexible tubing 204 from the connection interface 306. A shoulder 327 may cooperate with a snap ring 326 to secure the insulator 324. Further, the male connector 306 includes a thread interface 311 configured to mate with corresponding threads on an interior surface of the sleeve 310 to secure the male connector 306 against the female connector 304.

One or more electrical wires may extend through the annular cavity of the flexible tubing 202 through the quick-connect coupling 206 and to the annular cavity of the flexible tubing 204. Electrical wires 330 may couple to the quick-connect coupling 206 at connection 334, which extends through the insulator 316 to the coupling interface 305. Electrical wires 342 may couple to the quick-connect coupling 206 at connection 338, which may extend through insulator 324 to the coupling interface 305. At the coupling interface 305, a male-female connector 336 may electrically couple the electrical wires 330 to the electrical wires 342.

The flexible tubing 202 and 204 includes an inner wall 346 that defines a fluid passage 348 through which the harvested gas may flow. The flexible tubing 202 and 204 also includes an outer wall 344 that is spaced apart from the inner wall 346 and that defines an annular cavity 350 and 332. The annular cavity 350 and 332 of the flexible tubing 202 includes an incompressible insulating fluid 333, such as silicon oil. The annular cavity extends from within the flexible tubing to the insulator 316 within the female connector 304. Similarly, the annular cavity 350 within the flexible tubing 204 may be filled with an incompressible insulating fluid 340, such as silicon oil. The annular cavity 350 may extend to the insulator 324 within the male connector 306.

In certain embodiments, the female connector 304, the male connector 306, or both may include an annular pressure adjustment device that is configured to selectively vary an annular pressure within the annular cavity 350 in response to changes in external pressure or other factors. In certain embodiments, the annular pressure adjustment device may be a mechanical device that moves in response to external pressure. In certain embodiments, the annular pressure adjustment device may be an electrical circuit configured to apply a field (electrical or magnetic) to the fluid within the annular cavity to alter a characteristic of the fluid to change the annular pressure. Certain embodiments that utilize a mechanical annular pressure adjustment device are described below with respect to FIG. 4.

Figure 4:
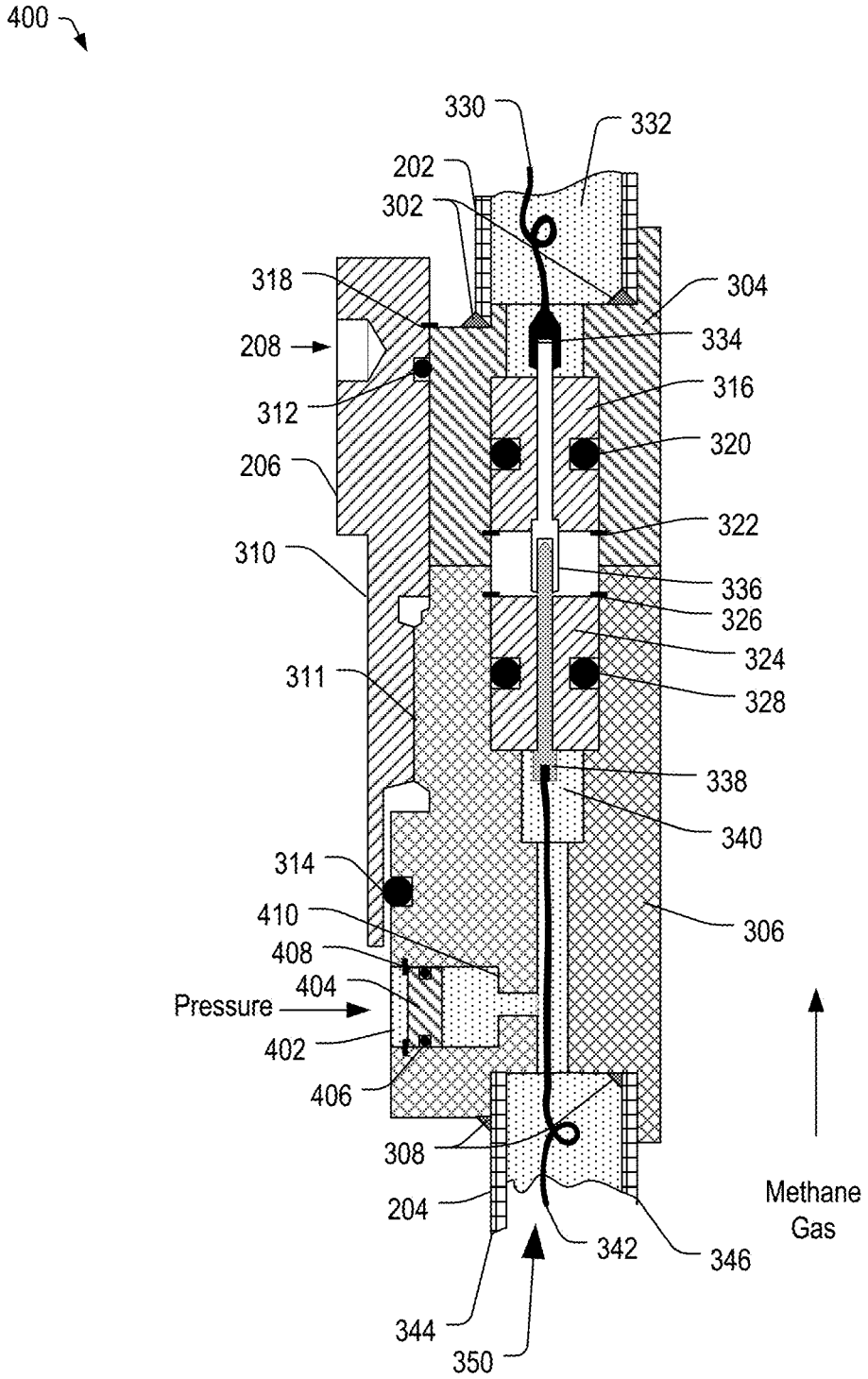
FIG. 4 is a cross-sectional view of the adjustable conduit including a plunger responsive to external pressure according to certain embodiments.

FIG. 4 is a cross-sectional view of an adjustable conduit 400 including a plunger 404 responsive to external pressure according to certain embodiments. The adjustable conduit 400 includes all of the elements of adjustable conduit 300 in FIG. 3, except that the sleeve 310 is shortened slightly and one of the O-rings 314 is omitted to allow room in the quick-connect coupling 206 for the plunger 404. In an alternative embodiment, the male connector 306 may be extended to allow room for the plunger 404.

In certain embodiments, the male connector 306 includes a pressure opening 402, which may be configured to expose a plunger 404 to external pressure. The plunger 404 may be sized to fit the opening and an O-ring 406 may provide a seal between the external environment and the annular cavity. Further, a snap ring 408 and a shoulder 410 may cooperate to secure the plunger 404 within the opening 402. In certain embodiments, in response to external pressure, the plunger 404 may move within the opening 402, varying pressure applied to the incompressible fluid within the annular cavity to selectively vary the annular pressure. In certain embodiments, the plunger 404 may move in response to the external pressure to equalize the annular pressure to the external pressure.

In certain embodiments, application of pressure to the incompressible oil increases the annular pressure to counteract the hoop stress pressure applied by the surrounding environment, allowing the conduit 114 to maintain flexibility while preventing the external pressure from collapsing the conduit 114, which would otherwise choke, throttle or collapse the fluid flow path 348 through the conduit 114.

Figure 5:
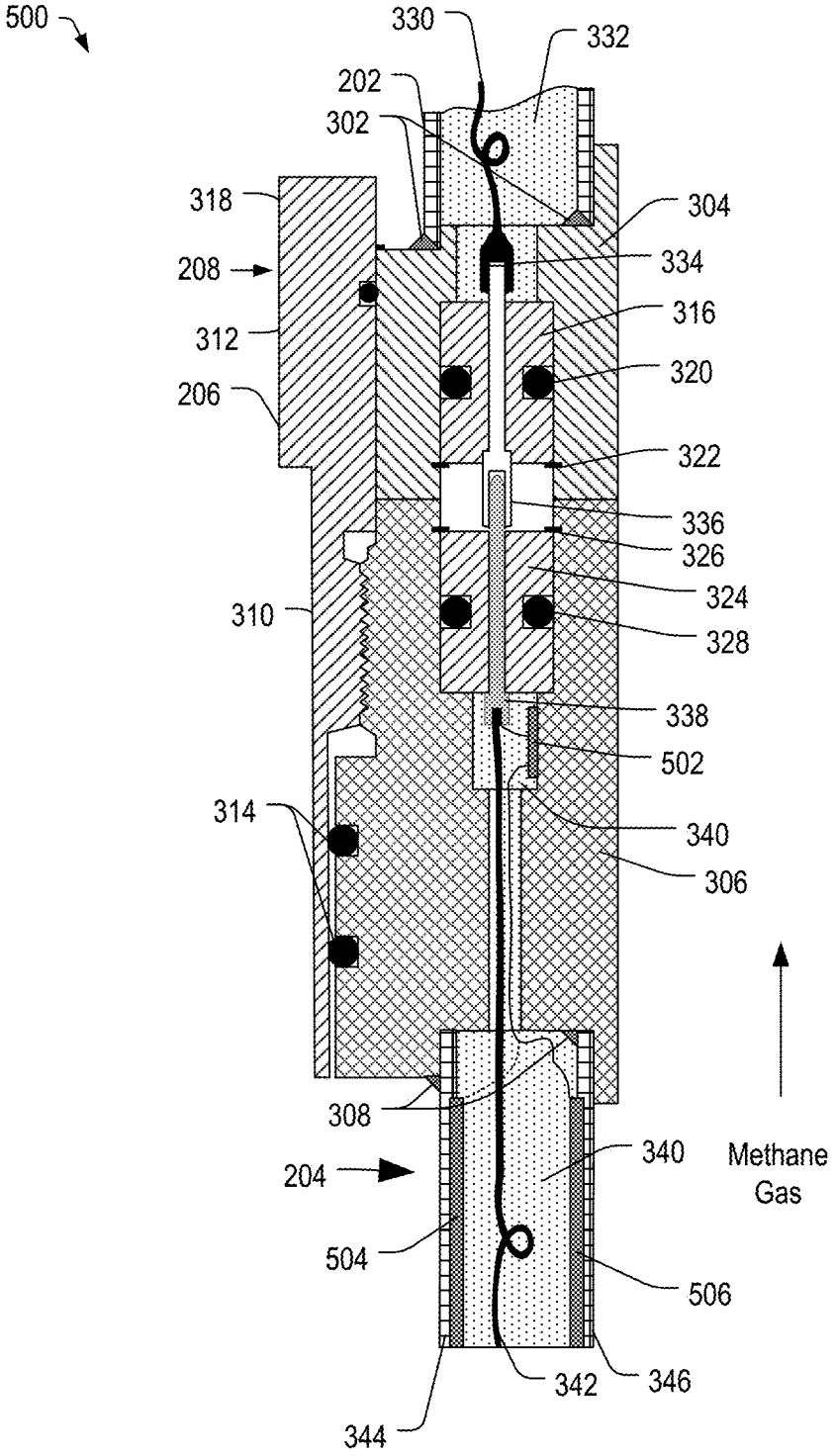
FIG. 5 is a cross-sectional view of the adjustable conduit including a circuit to apply a field to adjust a parameter of a smart fluid according to certain embodiments.

FIG. 5 is a cross-sectional view of the adjustable conduit 500 including a circuit 502 to apply a field to adjust a parameter of a smart fluid according to certain embodiments. The circuit 502 may be coupled to the connector 338 to receive power, control signals, or both. Further, circuit 502 may be coupled to a circuit element 504, a circuit element 506, or both, which may be coupled to the inner wall 342 of the flexible tubing 204, 202, or both. In certain embodiments, the circuit 502 may cooperate with the circuit element 504, the circuit element 506, or both to generate a field proximate to the insulating fluid 340. In certain embodiment, the generated field may be an electrical field or a magnetic field. In certain embodiments, the circuit 502 may communicate with circuit element 502 or 504 and the other may be omitted or may be coupled to the male connection 306. In certain embodiments, instead of responding to an applied field, the smart fluid within the annular cavity 350 may respond to an applied current or voltage to alter a characteristic of the smart fluid, in which case the circuit 502 may provide a signal to the circuit element 502 or 504 to alter the characteristic.

In certain embodiments, the circuit elements 504 and 506 may be positioned on the inner wall 342 and the outer wall 344 of the flexible tubing 204. In other embodiments, the circuit elements 504 and 506 may be distributed along the annular cavity and spaced apart to produce the electrical field at selected locations along the annular cavity. In certain embodiments, the circuit 502 may be configured to selectively activate one or more of the circuit elements 502 and one or more of the circuit elements 504 and to selectively provide power to the selected circuit elements 502 and 504 to produce a desired field.

Figure 6:
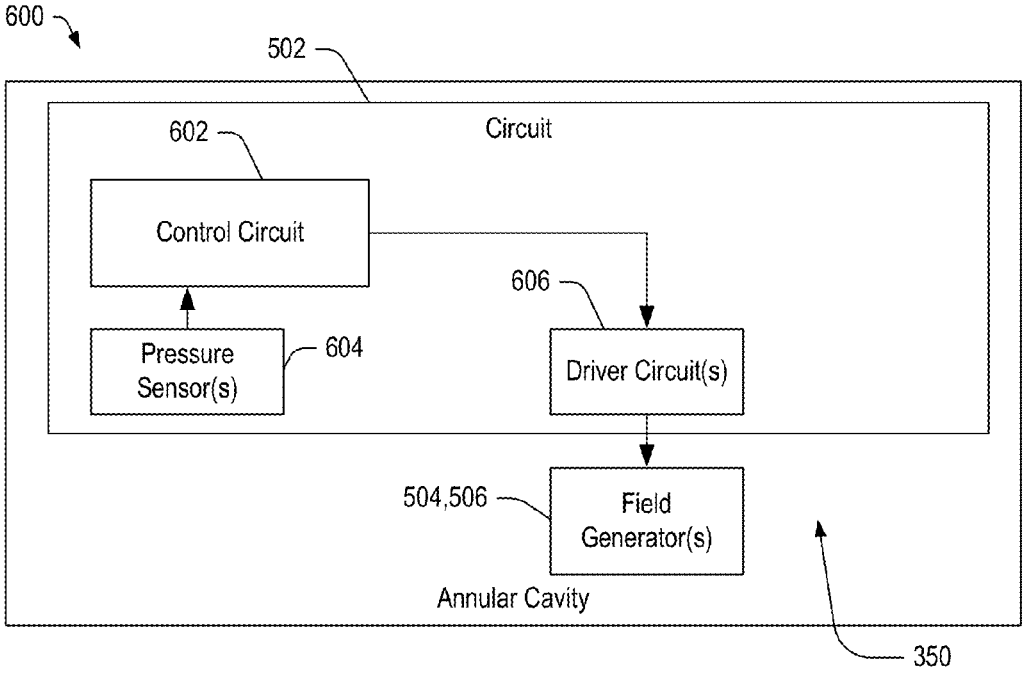
FIGS. 6 and 6A are block diagrams of the circuit of FIG. 5 configured to provide a field to adjust a parameter of a smart fluid according to certain embodiments.

FIG. 6 is a block diagram of a portion of a system 600 including the circuit 502 of FIG. 5 configured to provide a field to adjust a parameter of a smart fluid according to certain embodiments. The system 600 includes the circuit 502 and the annular cavity 350. The circuit 502 may include a control circuit 602, which may be coupled to one or more pressure sensors 604 to receive signals representing pressure within the annular cavity, to receive signals representing external pressure, other pressure signals, or any combination thereof. The control circuit 602 may also include one or more driver circuits 606, which may be coupled to one or more field generators, such as circuit elements 504 and 506, which may cooperate with one another or which may operate independently from one another to alter a characteristic of a smart fluid within the annular cavity 350 in response to a signal from the control circuit 602.

Figure 6A:
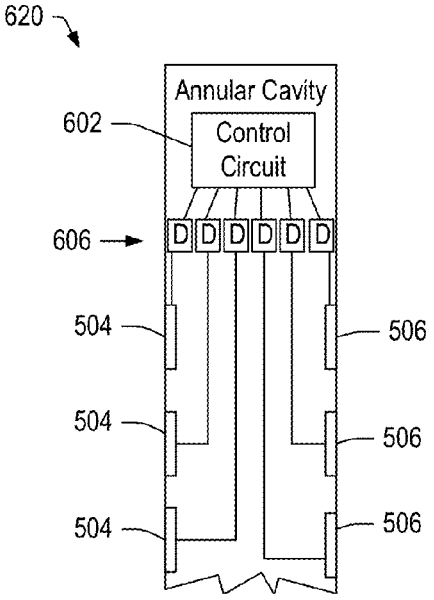

In certain embodiments, as depicted in FIG. 6A below and generally indicated at 620, the circuit elements 504 and 506 may be distributed longitudinally within the annular cavity to distribute the changed characteristic across the length of the annular cavity. In certain embodiments, the control circuit 602 may be configured to apply signals to selected ones of the one or more circuit elements 504 and 506 to achieve a desired characteristic of the fluid within the annular cavity 350. In an illustrative example, one or more of the circuit elements 504 and 506 may have its own drive circuit 606. In another illustrative example, one or more of the circuit elements 504 and 506 may share driver circuits 606. Additionally, while the circuit elements 504 are distributed along a first side and the circuit elements 506 are distributed along a second side (in the illustrated example), it should be appreciated that the arrangements of the circuit elements 504 and 506 may vary. In some embodiments, circuit elements 504 and 506 may be distributed in an alternating arrangement. Other configurations are also possible.

Figure 7:
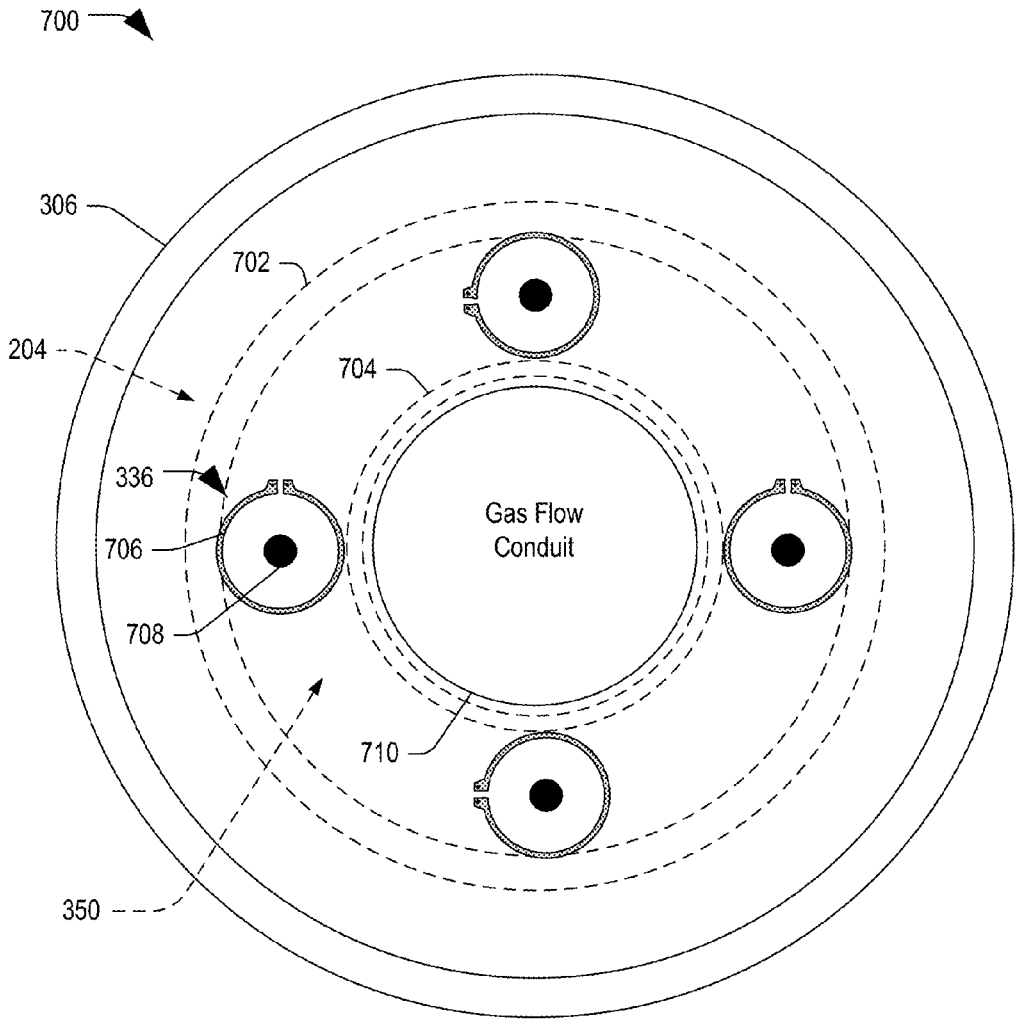
FIG. 7 is a top view of a connector of the adjustable conduit according to certain embodiments.

FIG. 7 is a top view 700 of the male connector 306 of the adjustable conduit according to certain embodiments. The male connector 306 may be coupled to the flexible tubing 204 (shown in phantom). The flexible tubing 204 includes an outer wall 702 and an inner wall 704. The inner wall 704 may define the gas flow conduit through the flexible tubing 204 and to the opening 710, which extends from the connection interface 305 to through the male connector 306 to the lumen of the flexible tubing 204. Further, the opening 710 may be configured to mate with a corresponding opening of the female connector 304, which in turn extends from the connection interface 305 through the female connector 304 to the flexible tubing 202.

The inner wall 704 and the outer wall 702 are spaced apart to define the annular cavity 350, which may be filled with an incompressible fluid, which may be a smart fluid. The flexible tubing 204 may be sealed to the male connector 306. The male connector 306 further includes a male portion 708 of the male-female connector 336 and includes a snap ring 706. Further, the male connector 306 may include a plurality of male-female connectors 336, which may electrically couple the male connector 306 to the female connector 304.

FIG. 8 is a diagram of a portion of the adjustable conduit 800 including an adjustable buoyancy device 802 according to certain embodiments. The adjustable conduit 800 may include features described above with respect to FIGS. 1-7, including an adjustable pressure device, such as a mechanical component or a circuit, configured to alter an annular pressure within an annular cavity that extends within the flexible tubing 202, the flexible tubing 204, or both. In certain embodiments, the adjustable conduit 800 includes one or more buoyancy devices, such as buoyancy device 802 and buoyancy device 804 (shown in phantom), which may be coupled to the quick-connect coupling 206. The adjustable conduit 800 may include a plurality of segments coupled at their respective ends by quick-connect couplings, and one or more of the segments may have one or more associated buoyancy devices. In certain embodiments, the quick-connect coupling 206 may include a mechanical, electrical, or electromechanical component 808, which may be coupled to an apparatus 806 within the buoyancy device 802. The component 808 may cooperate with the apparatus 806 to alter a buoyancy of the buoyancy device 802.

In certain embodiments, the component 808 may include a circuit configured to receive a signal corresponding to a depth and may include a controller configured to send a signal to the apparatus 806 to adjust a buoyancy of the buoyance device 802. In certain embodiments, the apparatus 806 may include a bi-directional valve and a controller that, in response to the signal from the component, may cause the buoyancy device 802 to take on fluid from the surrounding environment or to discharge previously acquired fluid in order to alter the buoyancy.

FIG. 9 is a block diagram of system 900 that may be configured to control the adjustable buoyancy device 802 of FIG. 8 according to certain embodiments. The system 900 is provided for illustrative purposes and is not drawn to scale. The system 900 may include the adjustable buoyancy device 802 configured to couple to a component, which is implemented as a circuit 808 in the illustrated example. The circuit 800 may include a control circuit 902 configured to receive a signal corresponding to a depth from a depth sensor 904 and coupled to a driver circuit 906. In response to the signal corresponding to the depth, the control circuit 902 may control the driver circuit 906 to send a control signal through one or more coupling interface 908 to the apparatus 806 of the adjustable buoyancy device 802.

The adjustable buoyancy device 802 may include the apparatus 806 coupled to a fluid reservoir 918 that may be configured to hold fluid from the environment. The apparatus 806 may include a controller circuit 910, which may be coupled to the circuit 808 through an input/output interface 912 and through the one or more coupling interfaces 908. The apparatus 806 may further include a pump 914 and a valve 916, both of which may be coupled to the controller circuit 910.

In certain embodiments, the control circuit 902 may determine a depth from the depth sensor 904 and may selectively provide a signal to driver circuit 906 for communication to the apparatus 806. In response to the signal, the controller circuit 910 may control the pump 914 to selectively draw water into or evacuate water from the fluid reservoir 918. In certain embodiments, fluid from the surrounding environment may be pumped into the fluid reservoir 918 to produce a fluid density and weight that is greater than that of the surrounding environment, causing the adjustable buoyancy device 802 to sink. In certain embodiments, fluid from the fluid reservoir 918 may be evacuated by pumping the fluid into the surrounding environment, reducing the fluid density and weight of the adjustable buoyancy device and causing the adjustable buoyancy device 802 to remain at a depth or to float up.

In certain embodiments, the circuit 808 may communicate data to and receive data from a control system that is at another location, such as on a ship at the surface of the water, via wires. In certain embodiments, the circuit 808 may be omitted, and a control system at another location may communicate with the adjustable buoyancy device through electrical connections (not shown) on the quick-connect coupling 206.

In the above discussion, various segments, annular fluids, and control circuits have been described. It should be appreciated that embodiments of the segments may be used with other embodiments in the same conduit system. In an example, the embodiment of the connector of FIG. 3 may be one end of a segment, and the connector of FIG. 4 may be on another end of the same segment. In certain embodiments, the segments having one type of connector and one type of fluid may be used in conjunction with segments having another type of connector and the same or a different type of fluid. In certain embodiments, the conduit system may include multiple segments where one of the segments includes a plunger to adjust an annular pressure in its segment, and another of the segments includes a plate or electrode to deliver a low-power control signal or to apply a field to a smart fluid to adjust its annular pressure, etc. Other configurations may be readily understood by one skilled in the art in view of this disclosure.

In certain embodiments, during deployment of the conduit system, some of the segments may be filled with a first fluid, such as an electrically insulative fluid (e.g., silicon oil). Others of the segments may be filled with a smart fluid (electrorheological or magnetorheological or another type). In certain embodiments, one of the segments may include a smart fluid responsive to an electrical field, one of the segments may include a smart fluid responsive to a magnetic field, another of the segments may include a smart fluid responsive to an environmental parameter (pressure, temperature, etc.), and another of the segments may include a plunger to vary a compressive force applied to an incompressible, electrically insulative fluid. In certain embodiments, one or more of the segments may be configured to equalize the internal annular pressure with the external pressure. In certain embodiments, one or more of the segments may be configured to control the annular pressure to adjust a characteristic of the conduit itself, such as flexibility or rigidity of the segment.

Figure 10:
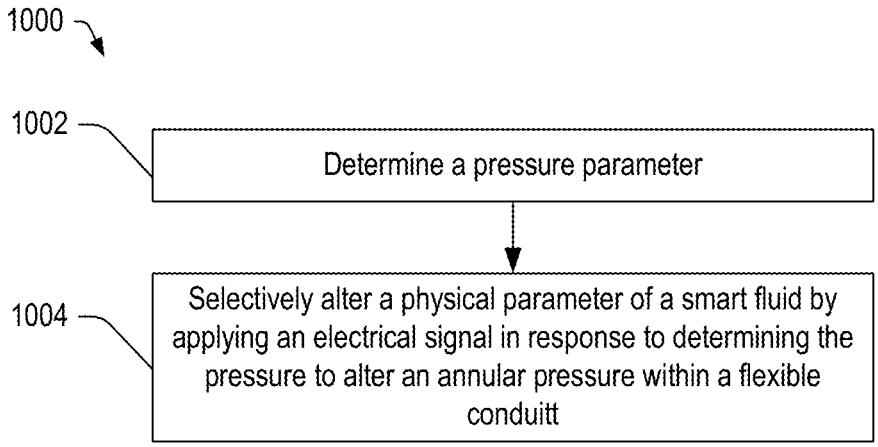
FIG. 10 is a flow diagram of a method of applying a field to a smart fluid according to certain embodiments.

FIG. 10 is a flow diagram of a method 1000 of applying a field to a smart fluid according to certain embodiments. At 1002, a pressure parameter is determined. In certain embodiments, the pressure parameter may be determined by a sensor or by a mechanical apparatus, such as the plunger 404 of FIG. 4. In the latter example, a magnet and a hall-effect sensor, a piezoelectric element or another type of sensor may be employed to detect movement of the plunger 404 and may generate a signal indicative of the pressure parameter to a circuit. Advancing to 1004, a physical parameter (or characteristic) of the smart fluid may be selectively altered by applying an electrical signal in response to the determining the pressure to alter an annular pressure within a flexible conduit. In certain embodiment, the electrical signal may trigger application of a field to the smart fluid within an annular cavity of flexible tubing, such as flexible tubing 202 and 204. The applied field may cause the smart fluid to change a characteristic, such as a phase (e.g., from a fluid state into a substantially solid state), a viscosity, another characteristic, or any combination thereof.

In certain embodiments, by altering a characteristic of the smart fluid, the annular pressure within the annular cavity of the flexible tubing may be changed, preventing the fluid passage from being throttled by hoop stresses applied by the surrounding environment. Additionally, in certain embodiments, a magnitude of the field (electric or magnetic) applied to the smart fluid may be varied to adjust the annular pressure to achieve a desired pressure. In certain embodiments, the annular pressure may be adjusted to provide a pressure that is substantially equal to the pressure applied by the surrounding environment.

Figure 11:
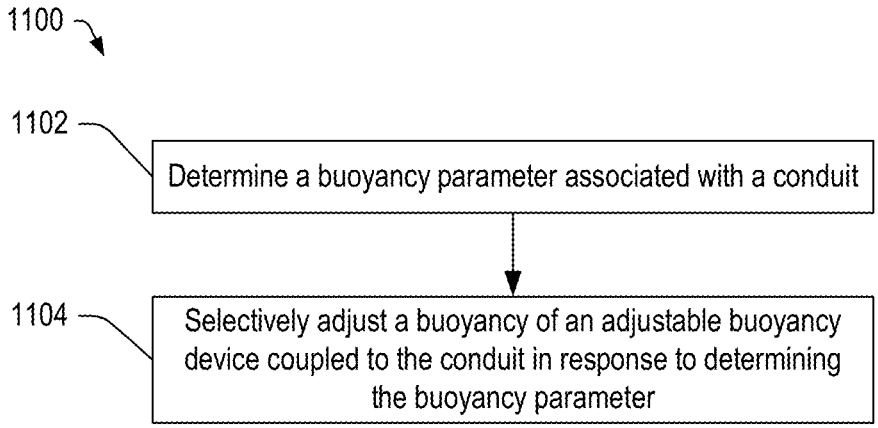
FIG. 11 is a flow diagram of a method of adjusting a buoyancy of an adjustable buoyancy device according to certain embodiments.

FIG. 11 is a flow diagram of a method 1100 of adjusting a buoyancy of an adjustable buoyancy device according to certain embodiments. At 1102, a buoyancy parameter associated with the conduit is determined. The buoyancy parameter may be a depth parameter, a motion parameter indicative of whether the conduit is rising, sinking, or floating (maintaining its depth).

Advancing to 1104, a buoyancy of an adjustable buoyancy device that is coupled to the conduit is selectively adjusted (varied) in response to determining the buoyancy parameter. In certain embodiments, fluid from the surrounding environment is pumped into the adjustable buoyancy device to increase its weight and density relative to the surrounding environment in order to sink the adjustable buoyancy device. In certain embodiments, fluid from a fluid reservoir within the adjustable buoyancy device is pumped out to reduce the fluid density to allow the adjustable buoyancy device to float at its current depth or to float upward.

In conjunction with the systems and methods described above with respect to FIGS. 1-11, in certain embodiments, an adjustable conduit is described that may include an annular cavity having an annular pressure that may be adjusted in response to pressure from the surrounding environment. The annular pressure may be adjusted by applying pressure to an incompressible fluid within the annular cavity or by altering a characteristic of the fluid within the annular cavity. Additionally, in certain embodiments, the adjustable conduit may include an adjustable buoyancy device that may store or expel fluid from the surrounding environment in order to selectively adjust the buoyancy of the adjustable buoyancy device, thereby altering the buoyancy of the conduit.

The processes, systems, devices, apparatuses, and circuits (and improvements thereof) described herein are particularly useful improvements for underwater applications, such as for methane clathrate harvesting applications. Further, the embodiments and examples herein provide improvements in the technology of fluid recovery, gaseous fluid flow management, and underwater harvesting systems. In addition, embodiments and examples herein provide improvements to the functioning of undersea and deep water conduits by providing a flexible conduit having both an adjustable flexibility parameter and an adjustable buoyancy parameter. Thus, the improvements herein provide for technical advantages, such as providing a conduit having adjustable flexibility. Further, the improvements herein provide additional technical advantages, such as providing a conduit having an adjustable buoyancy. While technical fields, descriptions, improvements, and advantages are discussed herein, these are not exhaustive and the embodiments and examples provided herein can apply to other technical fields, can provide further technical advantages, can provide for improvements to other technologies, and can provide other benefits to technology. Further, each of the embodiments and examples may include any one or more improvements, benefits and advantages presented herein.

In certain embodiments, the adjustable conduit may be utilized in oil and gas drilling applications having sensors on or near the drill bit, and especially for coiled tubing. In certain embodiments, a control system can monitor and power downhole sensors for real-time acquisition and logging of drilling information (data from the sensors) via wires extending through the fluid filled annular cavity. In response to the data, the control system can change the modulus of the drill pipe/conduit by applying a field (electric or magnetic) to the smart fluid in the annulus, selectively stiffening the conduit (pipe) to help hold or change the direction of the drill bit. In certain embodiments, the adjustable modulus can be used to avoid drilling problems such as corkscrewing or key-seating. Further, the adjustable conduit may be used with logging sensors to detect zones of interest.

In certain embodiments, the adjustable conduit may be utilized in geothermal and water drilling applications. A control circuit can send signals through the wires extending through the annular cavity to power and monitor sensors, to aid in seeking or directing the bit for precision drilling, placing development or production devices in the earth for geothermal or water production.

In certain embodiments, the adjustable conduit may be used in conjunction with harvesting or production robots that are configured to work on ocean sediments. The adjustable conduit may be used to carry gas or other materials to a ship at the surface. Further, wires extending through the annular cavity may be used to supply power and to monitor the harvesting unit.

In certain embodiments, the adjustable conduit may be used between sub-sea wells and sea-based terminal facilities or between other subsurface or surface sea-based facilities to convey gas or fluids from one facility to another. Further, the wires extending through the annular cavity may be used to provide power and sensor/control data. Many other possible applications for the adjustable conduit may also be possible.

The illustrations, examples, and embodiments described herein are intended to provide a general understanding of the structure of various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, in the flow diagrams presented herein, in certain embodiments, blocks may be removed or combined without departing from the scope of the disclosure. Further, structural and functional elements within the diagram may be combined, in certain embodiments, without departing from the scope of the disclosure. Moreover, although specific embodiments have been illustrated and described herein, it should be appreciated that any subsequent arrangement designed to achieve the same or similar purpose may be substituted for the specific embodiments shown.

This disclosure is intended to cover any and all subsequent adaptations or variations of various embodiments. Combinations of the examples, and other embodiments not specifically described herein, will be apparent to those of skill in the art upon reviewing the description. Additionally, the illustrations are merely representational and may not be drawn to scale. Certain proportions within the illustrations may be exaggerated, while other proportions may be reduced. Accordingly, the disclosure and the figures are to be regarded as illustrative and not restrictive.

What is claimed is:

1. An apparatus comprising:

a fluid conduit including a plurality of segments including a substantially flexible segment having concentric inner and outer sidewalls, the substantially flexible segment including:

an adjustable pressure device configured to vary an internal annular pressure of the substantially flexible segment to counteract external pressure from a surrounding environment;

a first connector coupled to the inner sidewall and the outer sidewall and having a first fluid passage opening configured to mate with the inner sidewall;

a second connector coupled to the inner sidewall and the outer sidewall and having a second fluid passage opening;

wherein the first connector and the second connector operate to seal the elongate annular cavity;

the first connector includes a first electrical interface;

and the second connector includes a second electrical interface.

2. The apparatus of claim 1, wherein the adjustable pressure device varies the internal annular pressure to substantially equalize the internal annular pressure to the external pressure.

3. The apparatus of claim 1, wherein the substantially flexible segment further comprises:

the inner sidewall formed of a first flexible material and defining a central fluid passage configured to mate with a corresponding fluid passage of others of the plurality of segments; and the outer sidewall formed of a second flexible material and spaced apart from the inner sidewall to form an elongate annular cavity.

4. The apparatus of claim 3, wherein the first flexible material is substantially the same as the second flexible material.

5. The apparatus of claim 1, further comprising one or more electrical conductors extending within the elongate annular cavity and configured to electrically couple the first and second electrical interfaces.

6. The apparatus of claim 1, further comprising a substantially incompressible fluid between the inner sidewall and the outer sidewall.

7. The apparatus of claim 6, wherein the adjustable pressure device comprises a piston configured to move in response to the external pressure to adjust the internal annular pressure by selectively applying a compressive force to the incompressible fluid to counteract hoop stresses.

8. The apparatus of claim 7, wherein the piston is disposed between the inner sidewall and the outer sidewall.

9. The apparatus of claim 1, wherein the plurality of segments further includes an other segment including an adjustable buoyancy device configured to provide a selected buoyancy.

10. The apparatus of claim 9, wherein the adjustable buoyancy device comprises a ballast coupled to the other segment.

11. The apparatus of claim 9, wherein the adjustable buoyancy device comprises:

a container coupled to the other segment; and a device configured to selectively adjust a ballast of the container by providing water from a surrounding environment into or out of the container to provide the selected buoyancy.

12. An apparatus comprising:

a tubular conduit including a substantially flexible segment, the substantially flexible segment including:

a first coupling element including a first electrical interface and a first fluid opening;

a second coupling element including a second electrical interface and second fluid opening; and a tubular structure including inner and outer tubular sections coupled between the first coupling element and the second coupling element, the inner tubular section configured to define a fluid passage from the first fluid opening to the second fluid opening, the outer tubular section spaced apart from the inner tubular section to define an annular space; and a fluid disposed within the annular space and configured to vary an internal annular pressure within the annular space of the substantially flexible segment to counteract external pressure from a surrounding environment.

13. The apparatus of claim 12, wherein the fluid comprises a smart fluid composition having at least one property that changes in response to variations in the external pressure to selectively vary the internal annular pressure.

14. The apparatus of claim 12, further comprising:

a circuit configured to apply an electrical field to the fluid; and wherein the fluid comprises an electrorheological fluid having a property that varies under the application of the electrical field to vary the internal annular pressure.

15. The apparatus of claim 12, further comprising an adjustable pressure device coupled to one of the first coupling element and the second coupling element and configured to move in response to the external pressure to vary the internal annular pressure.

16. The apparatus of claim 12, wherein the tubular conduit further comprises a second substantially flexible segment configured to electrically and physically couple to one of the first coupling element and the second coupling element.

17. An apparatus comprising:

a fluid conduit including a plurality of segments, at least one of the plurality of segments including:

first and second coupling elements, each coupling element including an electrical interface and a fluid opening;

a first tube coupled between the first and second coupling elements and configured to mate with the fluid openings to form a fluid path;

a second tube coupled between the first and second coupling elements and spaced apart from the first tube to form an annular space; and a fluid disposed within the annular space and configurable to vary an internal annular pressure of the annular space to counteract external pressure from a surrounding environment.

18. The apparatus of claim 17, further comprising an adjustable pressure device configured to move in response to the external pressure to vary the internal annular pressure.

19. The apparatus of claim 17, further comprising:

a piezoelectric element coupled to the at least one of the plurality of segments and adapted to produce an electrical signal in response to the external pressure;

a circuit configured to generate an electrical field in response to the electrical signal; and wherein the fluid comprises a smart fluid having a property that varies under the application of the electrical field to vary the internal annular pressure.

20. The apparatus of claim 19, wherein the property of the smart fluid comprises at least one of a fluid viscosity, a fluid volume, and a fluid density.

21. The apparatus of claim 19, wherein varying the internal annular pressure varies a flexibility property of the segment of the fluid conduit, wherein increasing the internal annular pressure decreases a flexibility of the segment.

22. The apparatus of claim 19, wherein decreasing the internal annular pressure increases the flexibility of the segment.

23. The apparatus of claim 17, wherein the plurality of segments further includes an other segment including an adjustable buoyancy device configured to provide a selected buoyancy, the adjustable buoyancy device comprises:

a container coupled to the other segment; and a device configured to selectively adjust a ballast of the container by providing water from a surrounding environment into or out of the container to provide the selected buoyancy.

* * * * *